US007380353B2

(12) United States Patent
Feller et al.

(10) Patent No.: US 7,380,353 B2
(45) Date of Patent: Jun. 3, 2008

(54) FOOTWEAR SOLE WITH FOREFOOT STABILIZER, RIBBED SHANK, AND LAYERED HEEL CUSHIONING

(75) Inventors: Craig Feller, Evergreen, CO (US); Mike McCarron, Danville, CA (US)

(73) Assignee: Ariat International, Inc., Union City, CA (US)

( * ) Notice: Subject to any disclaimer, the term of this patent is extended or adjusted under 35 U.S.C. 154(b) by 321 days.

(21) Appl. No.: 11/188,127

(22) Filed: Jul. 22, 2005

(65) Prior Publication Data

US 2007/0017122 A1 Jan. 25, 2007

(51) Int. Cl.
*A43B 13/42* (2006.01)
*A43B 23/00* (2006.01)

(52) U.S. Cl. ..... 36/76 R; 36/44; 36/108; 36/30 R; 36/35 R

(58) Field of Classification Search ..... 36/44, 36/103, 76 R, 107, 108, 30 R
See application file for complete search history.

(56) References Cited

U.S. PATENT DOCUMENTS 4,506,460 A * 3/1985 Rudy ..... 36/28
5,452,526 A * 9/1995 Collins ..... 36/76 R
5,722,186 A * 3/1998 Brown ..... 36/43
6,199,303 B1 * 3/2001 Luthi et al. ..... 36/31
6,497,057 B1 * 12/2002 Lee et al. ..... 36/35 R
6,497,058 B2 * 12/2002 Dietrich et al. ..... 36/69
2004/0111920 A1 * 6/2004 Cretinon ..... 36/30 R

FOREIGN PATENT DOCUMENTS

| | | |
|---|---|---|
| CH | 246465 | 1/1947 |
| DE | 33 21 847 A1 | 12/1983 |
| EP | 1 352 579 A1 | 10/2003 |
| WO | WO 2005/009162 A2 | 2/2005 |

* cited by examiner

*Primary Examiner*—Ted Kavanaugh
(74) *Attorney, Agent, or Firm*—Cooley Godward Kronish LLP

(57) ABSTRACT

A footwear sole includes a footwear sole base with a forefoot region, a mid-foot region, and a heel region. A lower heel cushion is positioned in the heel region. An upper heel cushion is positioned over the lower heel cushion. A shank with reinforcement ribs is positioned in the mid-foot region. A forefoot stabilizer is positioned in the forefoot region. The forefoot stabilizer includes an axial spine and lateral ribs to facilitate forward movement and lateral support. The footwear sole may be used in combination with a foot bed with a flexible base and a rigid orthotic structure. The foot bed may include elastomer cushioning domes at heel and metatarsal impact points. The foot bed may include a liner with moisture wicking and anti-microbe properties.

17 Claims, 5 Drawing Sheets

FOOTWEAR SOLE WITH FOREFOOT STABILIZER, RIBBED SHANK, AND LAYERED HEEL CUSHIONING

BRIEF DESCRIPTION OF THE INVENTION

This invention relates generally to footwear. More particularly, this invention relates to a footwear sole with components that promote shock absorption, foot stability and a natural gait.

BACKGROUND OF THE INVENTION

There have been various efforts to improve the properties of footwear soles. These efforts have been directed toward individual problems, such as shock absorption in the heel region. Unfortunately, even with a focus on individual problems, sub-optimal designs have been produced to address these issues. In addition, the focus on solving individual problems has resulted in designs that constitute a collection of disjointed components or layers. These designs are not integrated and do not otherwise operate in a sequential manner to improve footwear sole performance. In view of the foregoing, it would be desirable to provide an improved footwear sole. In particular, it would be desirable to provide a footwear sole that optimally addresses individual problems, such as shock absorption and foot stability, while operating in a coordinated manner to promote a natural gait.

SUMMARY OF THE INVENTION

The invention includes a footwear sole with a footwear sole base with a forefoot region, a mid-foot region, and a heel region. A lower heel cushion is positioned in the heel region. An upper heel cushion is positioned over the lower heel cushion. A shank with reinforcement ribs is positioned in the mid-foot region. A forefoot stabilizer is positioned in the forefoot region. The forefoot stabilizer includes an axial spine and lateral ribs to facilitate forward movement and lateral support. The footwear sole may be used in combination with a foot bed with a flexible base and a rigid orthotic structure. The foot bed may include elastomer cushioning domes at heel and metatarsal impact points. The foot bed may include a liner with moisture wicking and anti-microbe properties.

BRIEF DESCRIPTION OF THE FIGURES

The invention is more fully appreciated in connection with the following detailed description taken in conjunction with the accompanying drawings, in which.

Like reference numerals refer to corresponding parts throughout the several views of the drawings.

DETAILED DESCRIPTION OF THE INVENTION

Figure 1:
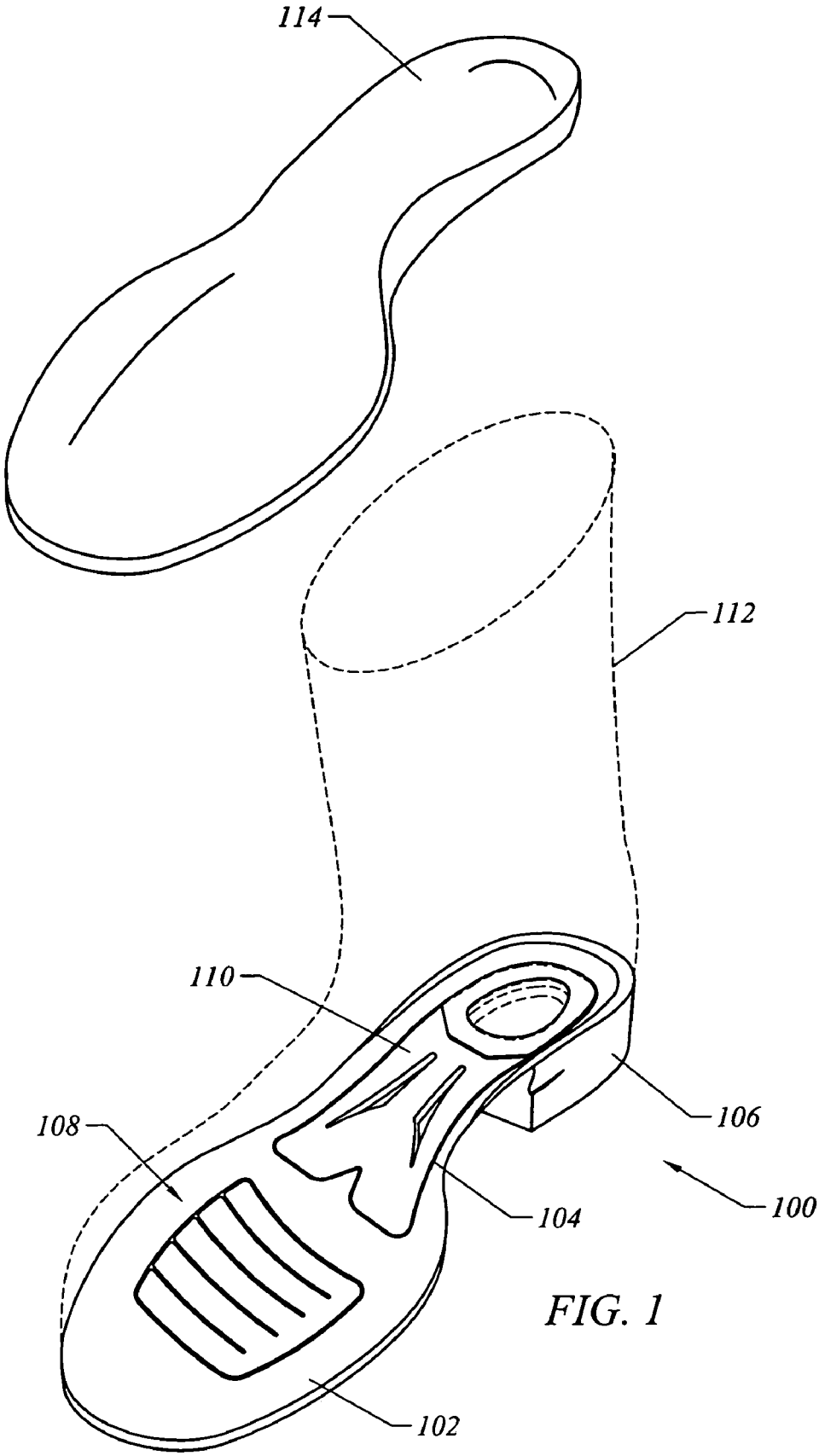
FIG. 1 is a perspective view of a footwear sole and associated foot bed configured in accordance with an embodiment of the invention.

FIG. 1 is a perspective view of a footwear sole base 100 configured in accordance with an embodiment of the invention. The footwear sole base 100 includes a forefoot region 102, a mid-foot region 104, and a heel 106. A forefoot stabilizer 108 is positioned in the forefoot region 102. A shank 110 is positioned in the mid-foot region 104. The footwear sole base 100 may be utilized in connection with any type of upper footwear structure 112, including a boot, shoe, and the like. FIG. 1 also illustrates a foot bed 114 that may be utilized in accordance with embodiments of the invention.

Figure 2:
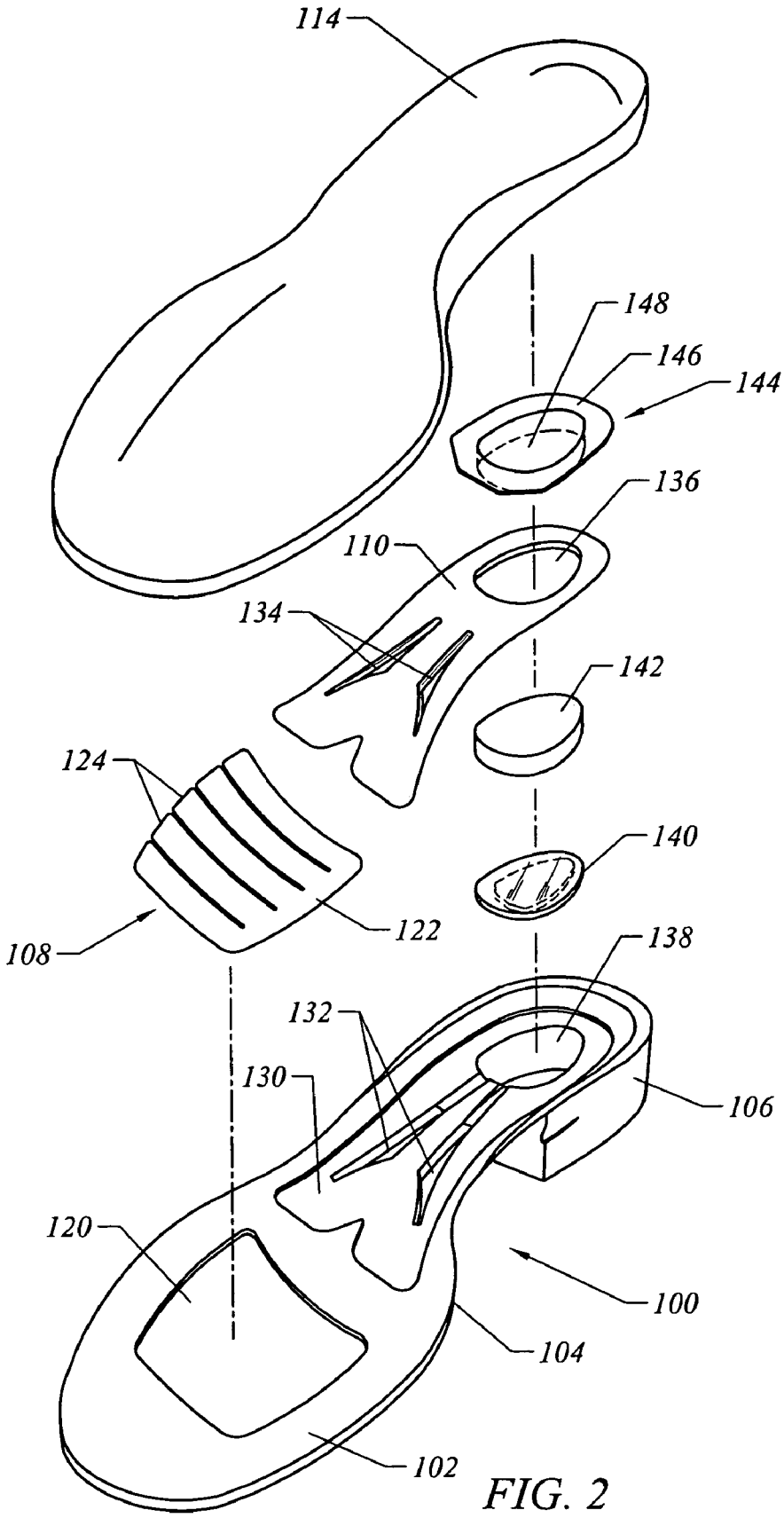
FIG. 2 is an exploded view of a footwear sole configured in accordance with an embodiment of the invention.

FIG. 2 is an exploded view of the footwear sole of the invention. FIG. 2 illustrates the footwear sole base 100, which may be formed from an injection molded solid rubber compound. The footwear sole base 100 has a forefoot stabilizer receptacle 120 positioned in the forefoot region 102. The forefoot stabilizer receptacle 120 is configured to receive the forefoot stabilizer 108. The forefoot stabilizer 108 includes a spine 122 and ribs 124. Alternate configurations in accordance with the invention include a centrally positioned spine 122, with ribs 124 positioned on both sides of the spine 122. In one embodiment, the forefoot stabilizer 108 is formed of nylon. The spine 122 and rib 124 configuration of the forefoot stabilizer 108 allows flexing of the forefoot in the longitudinal direction of the shoe, while providing lateral support and metatarsal stability, thus facilitating an aligned and natural gait.

The mid-foot region 104 includes a shank receptacle 130. In one embodiment, the shank receptacle 130 includes apertures 132 to receive the reinforcement ribs 134 of the shank 110. In the embodiment of FIG. 2, the shank 110 has a configuration with two reinforcement ribs 134. The shank 110 may be formed of thermal polyurethane through an injection molding process. The portion of the ribs 134 protruding through the apertures 132 may include decorative components, such as a diamond print applied via a color transfer process. The rib configuration provides rigidness to the shank. In one embodiment, the ribs 134 protrude from the shank 110, leaving a recess opposite the protruding portion. The recess reduces weight and manufacturing cost. Alternately, the recess may be filled to provide additional support. The configuration of the shank 110 and the ribs 134 provides stability against torsion or twisting forces, particularly in the mid-foot region. The shank 110 and the ribs 134 also operate to settle the foot into a balanced, neutral position, which facilitates proper body alignment and forward momentum. When formed from a composite material, the shank 110 does not conduct heat, cold or electricity, as in the case of a metal shank. A composite material may also be stronger and lighter weight than metal. The forefoot stabilizer 108 and the shank 110 may be attached to the footwear sole base 100 using any number of standard adhesives.

FIG. 2 also illustrates a stacked or layered heel cushioning configuration that may be used in accordance with an embodiment of the invention. The shank 110 forms an aperture 136 that has a size corresponding to an aperture 138 formed in heel 106. In one embodiment of the invention, a translucent heel window 140 is positioned at the base of the heel 106. The translucent heel window 140 may be formed of clear rubber. Preferably, the window 140 is treated to retard the onset of yellowing. For example, the heel window may be ultra-violet stabilized or may be colored a translucent blue to aid in non-yellowing. The heel window 140 may be attached to the heel 106 using a standard adhesive.

A lower heel cushion 142 is positioned on top of the translucent heel window 140. In one embodiment, the lower heel cushion 142 is a die cut rubber with an oval or egg-shaped perimeter. The die cut rubber may be a 60% ethyl vinyl acetate (EVA) combined with 40% blown rubber. In one embodiment, a cross-hatched grid is formed on the base of the lower heel cushion 142 adjacent to the translucent heel window 140. The cross-hatched grid maybe formed of diamonds, honeycombs, and the like. The lower heel cushion 142 operates to absorb and disperse shock. In addition, the lower heel cushion 142 operates to return energy from a heel strike to help propel the foot into the next stage of its gait, thus forming a rebound or propulsion action.

An upper heel cushion 144 is also used in accordance with an embodiment of the invention. The upper heel cushion 144 may include a perimeter flange 146 and a body 148. The perimeter flange 146 may be positioned above or below the shank 110. Thus, the perimeter flange 146 may be affixed to the footwear sole base 100 and/or the shank 110. In one embodiment, the perimeter flange 146 and the body 148 are formed from thermal polyurethane. The thermal polyurethane preferably encapsulates a gel, such as a thermo plastic rubber gel. The gel may be configured as a partial or complete cross-hatched grid. The upper heel cushion 144 operates to provide additional cushioning and shock dispersion.

Figure 3:
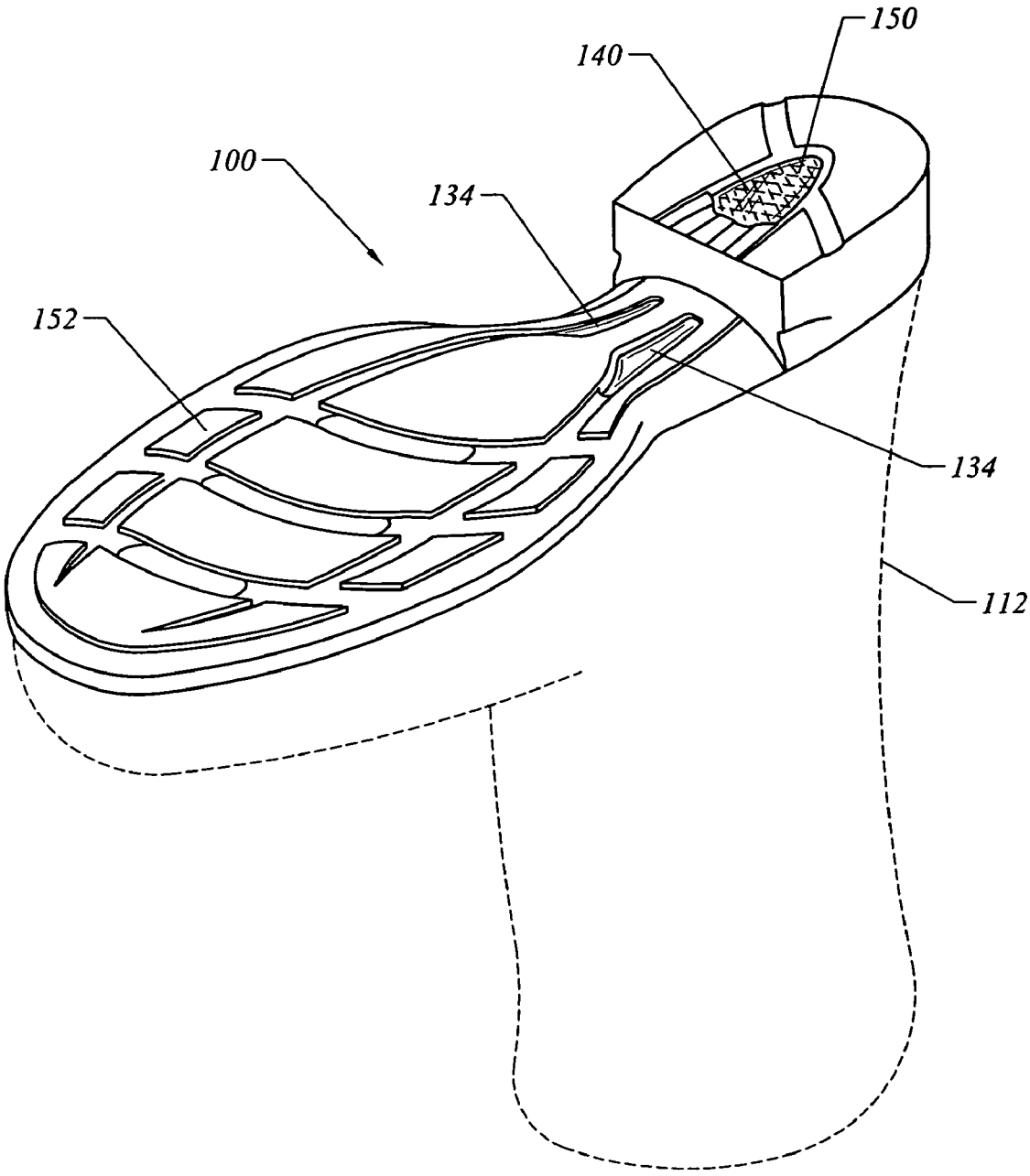
FIG. 3 is a perspective view of the bottom of a footwear sole associated with an embodiment of the invention.

FIG. 3 illustrates the bottom of the footwear sole base 100. In particular, the figure illustrates a forefoot traction pattern 152. The figure also illustrates reinforcement ribs 134 of the shank 110 protruding through the footwear sole base 100. In addition, the figure illustrates the translucent heel window 140 and a cross-hatched grid pattern 150 forming a portion of the lower heel cushion 144.

Figure 4:
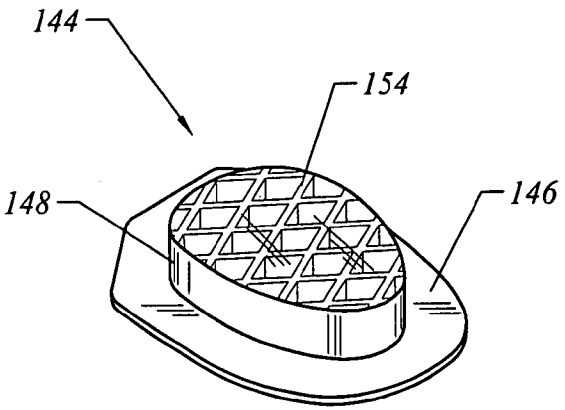
FIG. 4 is a perspective view of an upper heel cushion configured in accordance with an embodiment of the invention.

FIG. 4 is a perspective view of the upper heel cushion 144, including the perimeter flange 146 and the body 148. FIG. 4 illustrates a gel 154 positioned within the body 148. In this embodiment, the gel 154 is in a cross-hatched configuration.

Figure 6:
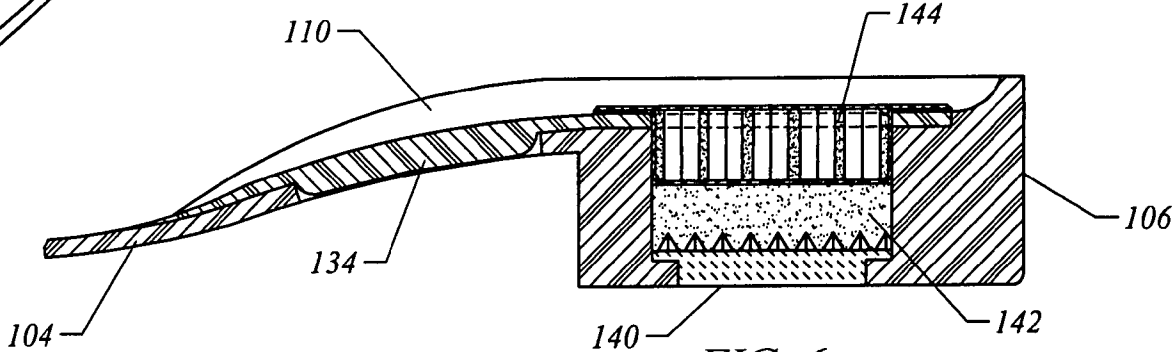
FIG. 6 is a cross-sectional view taken along the line 5-5 of FIG. 6.
Figure 5:
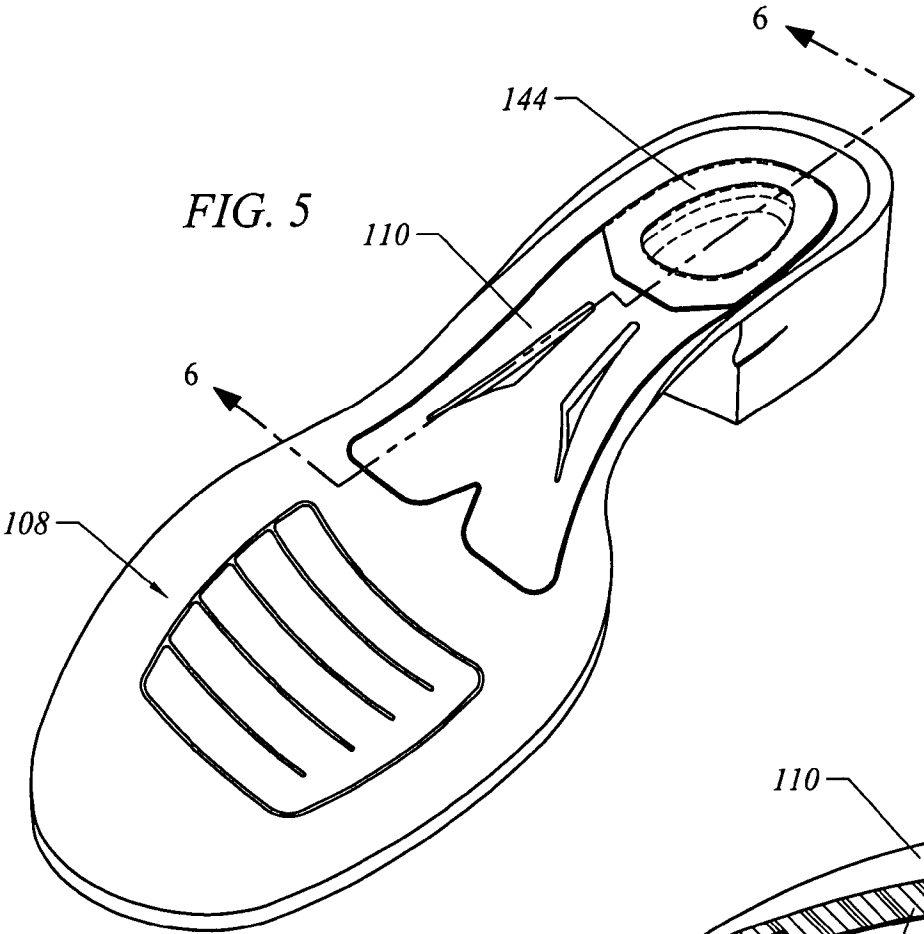
FIG. 5 is a perspective view of constructed components of a footwear sole configured in accordance with an embodiment of the invention.

FIG. 5 is a perspective view of a constructed footwear sole, including the forefoot stabilizer 108, the shank 110 and upper heel cushion 144. FIG. 6 is a cross-sectional view taken along the line 6-6 of FIG. 5. FIG. 6 illustrates the shank 110, with its protruding reinforcement rib 134. The figure also illustrates the positioning between the mid-foot region 104 of the footwear sole 100 and the shank 110. FIG. 6 also illustrates the translucent heel window 140, the lower heel cushion 142, and the upper heel cushion 144. Observe that on the lower heel cushion 142, only the bottom portion of the heel cushion 142 has a cross-hatched grid. In contrast, in the upper heel cushion 144, the entire structure may be cross-hatched, as shown. Alternately, the cross-hatching may be limited to the bottom portion of the cushion 144, as is the case with the lower heel cushion 142.

Figure 7:
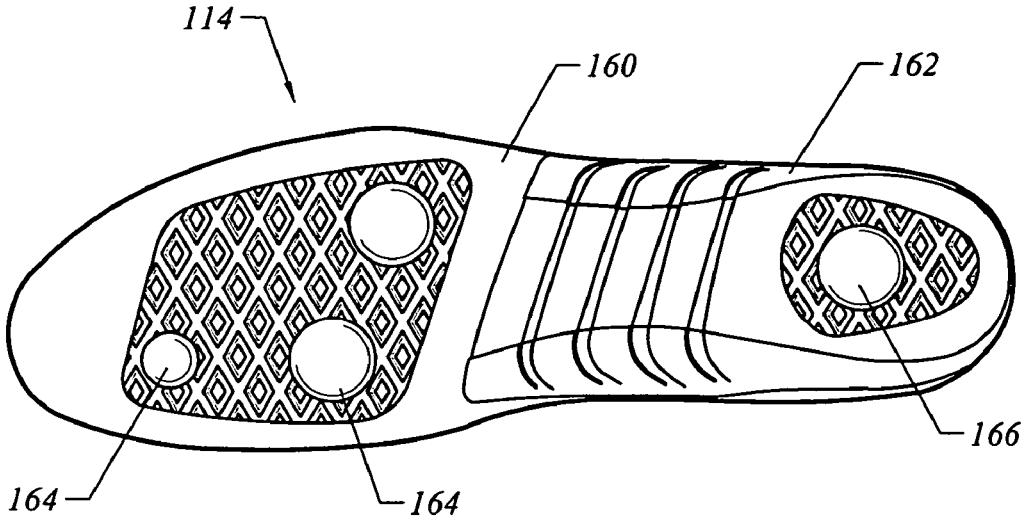
FIG. 7 is a view of the bottom of a foot bed utilized in accordance with an embodiment of the invention.
Figure 8:
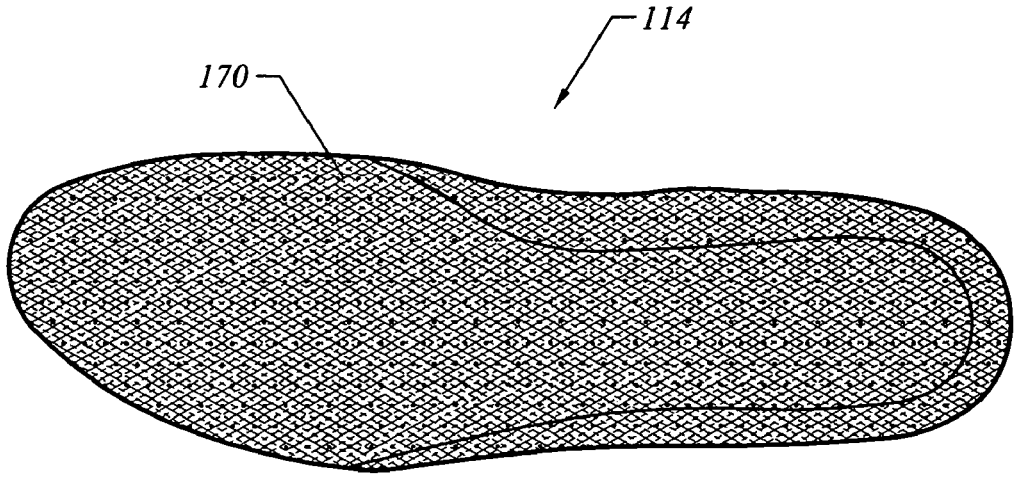
FIG. 8 is a top view of a foot bed utilized in accordance with an embodiment of the invention.

FIG. 7 illustrates a bottom view of a foot bed 114 that may be used in combination with the footwear sole base 100. The foot bed 114 may be constructed with a flexible base 160, such as a closed cell polyurethane. A rigid orthotic support 162 may be used in connection with the flexible base 160. By way of example, the rigid orthotic support 162 may be formed of nylon and may be configured to provide arch support and stability against torsion. The foot bed 114 includes elastomer cushioning domes 164 at metatarsal impact points. The elastomer domes may be formed of polyurethane. An elastomer cushioning dome 166 is also preferably positioned at the heel. The dome structures provide additional shock absorption and cushioning.

FIG. 7 is a top view of the foot bed 114. The foot bed 114 includes a foot bed liner 170 which provides moisture wicking and anti-microbe functions. For example, the foot bed liner 170 may be formed of polyester.

The structural components of the footwear sole base 100 operate in a coordinated manner. Upon heel strike, the lower heel cushion 142 absorbs and disperses the shock force through the relatively rigid rubber structure. This action may be augmented with the cross-hatched configuration at the bottom of the lower heel cushion 142. The upper heel cushion 144 supplements this function via the relatively soft gel. The shank 110 with its reinforcement ribs 134 subsequently operates to settle the foot in a balanced position to reduce twisting and faltering, particularly in the mid-foot region. This facilitates proper body alignment and forward momentum. As the natural foot gait progresses, the forefoot stabilizer 108 provides forefoot flexing, while reducing lateral movement, thereby providing metatarsal stability in the forefoot region. This promotes balance and forward momentum. The flexible base 160 of the foot bed 114 augments the natural gait, while the orthotic structure 162 provides arch support and torsional stability. Further, the elastomer domes 164 and 166 of the foot bed 114 provide additional shock absorption and cushioning. Thus, the footwear sole 100 and foot bed 114 advantageously facilitate any number of activities, including horseback riding.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

The invention claimed is:

1. A footwear sole, comprising:

a footwear sole base with a forefoot region with a forefoot stabilizer receptacle, a mid-foot region with a shank receptacle, and a heel region;

a lower heel cushion positioned in said heel region;

an upper heel cushion positioned over said lower heel cushion;

a shank with axially aligned reinforcement ribs in said mid-foot region, said reinforcement ribs extending through apertures formed in said shank receptacle; and a forefoot stabilizer positioned in said forefoot stabilizer receptacle, said forefoot stabilizer including an axial spine and lateral ribs to facilitate forward movement and lateral support.

2. The footwear sole of claim 1, wherein said heel region includes a translucent window.

3. The footwear sole of claim 2, wherein said translucent window is treated to retard yellowing.

4. The footwear sole of claim 1 wherein said lower heel cushion is formed of die cut rubber.

5. The footwear sole of claim 4 wherein said lower heel cushion is a combination of ethyl-vinyl acetate and blown rubber.

6. The footwear sole of claim 4 wherein said lower heel includes a cross-hatched grid adjacent to said translucent window.

7. The footwear sole of claim 1 wherein said upper heel cushion includes a gel.

8. The footwear sole of claim 7 wherein said upper heel cushion includes a thermo plastic rubber gel encapsulated in thermal polyurethane.

9. The footwear sole of claim 7 wherein said upper heel cushion has a cross-hatched grid.

10. The footwear sole of claim 1 wherein said shank is formed of a composite material.

11. The footwear sole of claim 10 wherein said shank is formed of thermal polyurethane through an injection molding process.

12. The footwear sole of claim 1 wherein said forefoot stabilizer is formed of nylon.

13. The footwear sole of claim 1 in combination with a foot bed.

14. The footwear sole and foot bed combination of claim 13 wherein said foot bed includes a flexible structural base and a rigid orthotic structure.

15. The footwear sole and foot bed combination of claim 13 wherein said foot bed includes elastomer cushioning domes.

16. The footwear sole and foot bed combination of claim 15 wherein said elastomer cushioning domes are positioned at heel and metatarsal impact points.

17. The footwear sole and foot bed combination of claim 13 wherein said foot bed includes a foot bed liner with moisture wicking and anti-microbe properties.

* * * * *